US006408932B1

(12) United States Patent
Steele et al.

(10) Patent No.: US 6,408,932 B1
(45) Date of Patent: Jun. 25, 2002

(54) HEAT EXCHANGER HAVING HIGH MOISTURE TRANSFER CAPABILITY IN HIGH RELATIVE HUMIDITY AIR

(75) Inventors: Donald F. Steele, Cohasset, MA (US); Lawrence C. Hoagland, Center Harbor, NH (US)

(73) Assignee: Airxchange, Inc., Rockland, MA (US)

( * ) Notice: Subject to any disclaimer, the term of this patent is extended or adjusted under 35 U.S.C. 154(b) by 0 days.

(21) Appl. No.: 09/523,352

(22) Filed: Mar. 10, 2000

(51) Int. Cl.[7] ..... F23L 15/02
(52) U.S. Cl. ..... 165/8; 165/10
(58) Field of Search ..... 165/4, 6, 8, 9, 165/10

(56) References Cited

U.S. PATENT DOCUMENTS

| | | | | | |
|---|---|---|---|---|---|
| 3,825,063 | A | * | 7/1974 | Cowans | 165/141 |
| 4,719,761 | A | | 1/1988 | Cromer | 62/94 |
| 4,875,520 | A | * | 10/1989 | Steele et al. | 165/10 |
| 5,454,418 | A | * | 10/1995 | Brophy et al. | 165/8 |
| 5,937,933 | A | | 8/1999 | Steele et al. | 165/10 |
| 6,252,317 | B1 | * | 7/2001 | DeGregoria et al. | 165/8 |

FOREIGN PATENT DOCUMENTS

| | | | | |
|---|---|---|---|---|
| GB | 162250 | * | 7/1925 | 165/8 |
| GB | 291402 | * | 12/1928 | 165/8 |

OTHER PUBLICATIONS

1989 *ASHRAE Handbook*, Fundamentals, I–P Edition, Chapter 18, pp. 18.5 and 18–6, and Chapter 19, pp. 19.1 and 19.6.

B. G. Nimmo, Ph.D. et al., " DEAC: Desiccant Enhancement Of Cooling–Based Dehumidification" , *ASHRAE Transactions: Symposia*, CH–93–4–4, pp. 842–848.

Eileen E. Chant, Ph.D. et al., Reprint for inclusion in "*ASHRAE Transactions*", 1994, v. 100, Pt. 2, A Steady–State Simulation Of An Advanced Desiccant–Enhanced Cooling And Dehumidification System.

* cited by examiner

*Primary Examiner*—Christopher Atkinson
(74) *Attorney, Agent, or Firm*—McDermott, Will & Emery

(57) ABSTRACT

A regenerator energy exchange device comprises an energy recovery wheel having interchangeable segments of a heat and moisture exchange matrix material. Each segment may include one or more desiccants having different moisture adsorption characteristics deposited thereon. Alternatively, the energy recovery wheel may contain a matrix which is uniformly coated with at least two different desiccants. In still another embodiment, the wheel may have zones of different desiccants or desiccant combinations which are arranged in series in the direction of air flow through the matrix to provide different moisture adsorption characteristics along the air flow path. The zone closest to a highly humid airstream may contain, for example, a type 5 desiccant, while the zone closest to a conditioned exhaust airstream may contain a type 3 desiccant. All configurations are designed to increase the effectiveness of the energy recovery device over the middle to high range of relative humidities.

13 Claims, 3 Drawing Sheets

HEAT EXCHANGER HAVING HIGH MOISTURE TRANSFER CAPABILITY IN HIGH RELATIVE HUMIDITY AIR

TECHNICAL FIELD

The present invention relates generally to regenerator energy exchange units, and more particularly to the heat- and humidity-adsorbing matrix through which intake and exhaust air streams flow.

BACKGROUND OF THE INVENTION

Regenerator energy exchange units, and in particular energy recovery wheels, are commonly used in building ventilation systems to precondition outside air that is to be introduced into a building so as to maintain a healthy indoor air quality. Depending on the climate and the season, outside air entering a conditioned building is typically either hotter or cooler, and either moister or drier, than the inside air. This invention primarily addresses the high moisture transfer rates required under humid outdoor summer conditions with hotter, more humid outdoor air. The outdoor air thus presents a load to the building's heating, ventilation and air conditioning (HVAC) equipment in the building, because the difference in temperature and humidity of the outside and inside air must be accommodated by that equipment. Inside (conditioned) air is typically exhausted to the outside to accommodate the introduction of fresh outside air. The conditioned inside air being exhausted can thus be used to precondition outside fresh air by transferring heat and humidity between it and the entering fresh outdoor air. The outside air can hence enter a conditioned space which is nearer in temperature and humidity to the desired inside conditions, and therefore the outside air presents a smaller load to the building's HVAC system. The desired comfort zone for indoor air conditions is between 40 and 50% relative humidity (RH) in summer conditions.

Rotary energy exchange devices typically contain a matrix made of a heat-exchange material which may be coated with a desiccant to provide for the transfer of moisture. Such devices operate by alternately storing and releasing heat and humidity. The matrix material is typically a porous or channeled structure that allows air to pass through it. The rotary exchange wheel is placed in an airflow path so that an intake or supply airstream flows through one half of the wheel in one direction and an exhaust airstream flows through the other half of the wheel in the opposite direction. The opposing airstreams are separated by a seal, and the wheel is slowly and continuously rotated as the airstreams pass through it. Because of the heat capacity of the matrix material, heat is absorbed from the warm fresh intake air and is then released to cooler, drier exhaust air. Because of the presence of a desiccant on the matrix, moisture is adsorbed from the warm fresh humid intake air and is then released to the cooler, drier exhaust air. Thus, the intake air from the outside, which is required to maintain a healthy indoor environment, enters the conditioned space cooler and drier than if it were introduced directly from outside, hence imposing a reduced load on the HVAC system.

Outdoor temperature and humidity conditions during the cooling season often cover a range from high temperatures with moderate relative humidity (e.g., 95–100° F. with a RH of 40%–50%) to moderate temperatures with high relative humidity (e.g., 75–80° F. with 90%–100% RH). Both of these conditions represent high absolute humidity levels (i.e., high dew points of 72–78° F.) in which a large amount of moisture must be removed from outdoor air to reduce the humidity to indoor comfort levels. An effective energy recovery wheel must therefore be capable of efficient operation over this range of conditions, i.e., it must exchange moisture effectively between airstreams having relative humidity values between 40% and 100%. This requires selection of desiccants which operate effectively over this range.

A desiccant functions by adsorbing moisture from its surroundings into micropores of the desiccant material. The capacity of a desiccant for moisture adsorption is a function of the type and amount of desiccant used. However, desiccants vary in their inherent adsorption characteristics, and the use of large quantities of a desiccant having a relatively low adsorption loading curve will not necessarily result in greater moisture transfer. Therefore, materials having a greater capacity to adsorb moisture can be used in smaller quantities, and this feature can provide a significant economic and practical benefit.

The equilibrium moisture adsorption performance of most desiccants can be described by a simple loading curve of weight percent water adsorbed versus relative humidity of the air in equilibrium with the desiccant. FIG. 1 shows typical loading curves for three different classes of desiccant. Molecular sieves, also referred to as zeolites, adsorb water most effectively at low relative humidities and are commonly used for drying substances to very low humidity levels. However, zeolites have very little additional adsorption capacity in air having a relative humidity above about 30%. Desiccants with very convex adsorption curves, such as molecular sieves, are often referred to as Type 1 desiccants in the Brunauer classification system.

Normal silica gel is a very popular desiccant for energy recovery. It has a relatively linear adsorption profile and will adsorb moisture comparably at virtually all relative humidity levels and will reach a maximum capacity of about 40% of its weight. Zeolites, by comparison, tend to have a lower maximum moisture adsorption capacity. Linear desiccants such as normal silica gel are often referred to as Type 3 desiccants in the Brunauer classification system. Often the normal silica gel characteristic begins to flatten out at high relative humidities approaching 100% as shown by the line curve in FIG. 1. This reduces their effectiveness somewhat at high relative humidities.

It is an object of this invention to provide a means to enhance the moisture transfer capability of rotary energy recovery devices at high relative humidity conditions by employing a different silica gel, shown also in the loading chart of FIG. 1. This so-called "modified" silica gel has a profile which is concave at low relative humidities with a steeper slope at high relative humidities. It also has a considerably higher total moisture capacity than either zeolites or normal silica gels. It may be referred to as a Type 5 characteristic in the Brunauer classification system. Such desiccants have largely been ignored by designers and engineers who are typically seeking deep drying characteristics, and the best drying activity at low relative humidity. For energy recovery from ventilating air, as described above, one can imagine that the moisture-adsorption capacity of a desiccant at higher relative humidities is more important.

Nevertheless, an energy recovery ventilator must function at all conditions it encounters and there are times, or seasons, when the outdoor air may be quite hot, but with a relatively low relative humidity. It is clear that one would prefer to have a desiccant with the characteristics of normal silica gel (Type 3) at some times and of modified silica gel (Type 5) at other times. Thus, it would be advantageous to provide an energy recovery unit which combines the moisture capacity characteristics of two or more different desiccants so as to maximize moisture transfer effectiveness from intake air to exhaust air.

SUMMARY OF THE INVENTION

According to one aspect of the invention, there is provided a regenerator energy exchange device, comprising:

a frame which is rotatable about a rotation axis; and an energy exchange matrix supported by the frame and disposed to allow intake and exhaust air to pass therethrough in countercurrent flow. The matrix comprises a plurality of interchangeable segments, each segment containing at least one desiccant selected from the family of desiccants having Brunauer classification numbers between 1 and 5. The matrix contains desiccants of at least two different Brunauer classifications.

In one embodiment, each segment may contain a single class of desiccant thereon. Alternatively, at least one segment contains multiple different classes of desiccant thereon. In another embodiment, all segments contain multiple different classes of desiccant thereon. The segments may all contain the same multiple classes of desiccants, or they may all contain different multiple classes of desiccants.

In a preferred embodiment, the matrix contains at least one Type 5 desiccant. The matrix can additionally include at least one desiccant selected from the group consisting of Type 1 and Type 3 desiccants.

The frame includes a hub, a plurality of spokes extending from the hub, and a rim coupled to the spokes.

According to another aspect of the invention, there is provided a regenerator energy exchange device, comprising:

a frame which is rotatable about a rotation axis, the frame including a hub, a plurality of spokes extending from the hub, and a rim coupled to the plurality of spokes; and an energy exchange matrix supported by the frame and disposed to allow intake and exhaust air to pass therethrough along a flow path. The matrix includes a plurality of zones disposed serially along the flow path and contains at least one desiccant selected from the family of desiccants having Brunauer classification numbers between 1 and 5. Each zone contains a desiccant of a different class.

In one embodiment, the matrix includes a first zone closest to an intake airstream inlet and a second zone closest to an exhaust airstream inlet.

In another embodiment, the matrix may comprise a plurality of interchangeable segments, each segment containing at least one of the desiccants.

The frame for the device may include a hub, a plurality of spokes extending from the hub, and a rim coupled to the plurality of spokes.

According to still another aspect of the invention, there is provided a regenerator energy exchange device, comprising a frame which is rotatable about a rotation axis, and an energy exchange matrix supported by the frame and disposed to allow intake and exhaust air to pass in counterflow therethrough along a flow path. The matrix contains at least two desiccants selected from the family of desiccants having Brunauer classification numbers between 1 and 5. At least one of the desiccants has a Brunauer classification number between 1 to 3 inclusive, and at least one of the desiccants has a Brunauer classification number between 3 and 5 inclusive. Each desiccant in the matrix has a different Brunauer classification number.

According to still another aspect of the invention, there is provided a regenerator energy exchange device, comprising a plurality of frames which are rotatable about a common rotation axis, and a corresponding plurality of energy exchange matrices, each matrix being supported by a frame and disposed to allow intake and exhaust air to pass in counterflow therethrough along a flow path. Each matrix contains at least one desiccant selected from the family of desiccants having Brunauer classification numbers between 1 and 5. The device includes a first matrix closest to an intake airstream inlet and a second matrix closest to an exhaust airstream inlet. In a preferred embodiment, the first matrix contains at least one desiccant having type 3 to type 5 Brunauer adsorption characteristics, and the second matrix contains at least one desiccant having type 1 to type 3 Brunauer adsorption characteristics.

These and other objects and advantages of the invention will in part be obvious and will in part appear hereinafter. The invention accordingly comprises the apparatus possessing the construction, combination of elements and arrangement of parts which are exemplified in the following detailed disclosure, the scope of which will be indicated in the claims.

BRIEF DESCRIPTION OF THE DRAWINGS

For a fuller understanding of the nature and objects of the present invention, reference should be made to the following detailed description taken in connection with the accompanying drawings, in which.

Like features in the drawings are indicated with like numerals.

DETAILED DESCRIPTION OF THE DRAWINGS

The present invention describes, in one aspect, an energy exchange wheel which has an energy exchange matrix which is comprised of removable segments which are interchangeable. The segments of the matrix may each contain a different type of desiccant and therefore have different moisture loading capacities, or they may contain multiple types of desiccants on one segment in any combination that is suitable for a particular application. This feature allows the matrix of the energy exchange wheel to be customized to a wide variety of temperature and humidity conditions which may occur throughout a season or seasons in a given locale. The result is enhanced indoor air comfort year-round and more efficient transfer of moisture from incoming air to exhaust air, especially in climates and seasons characterized by high relative humidities and moderate outdoor temperatures.

In another aspect, the invention describes an energy exchange wheel which has a multizone energy exchange matrix. The zones are arranged in series in the direction of air flow through the wheel, so that incoming air first contacts and passes through a first zone having a first set of heat and/or moisture transfer characteristics, and exhaust air first contacts and passes through a second zone having a second set of heat and/or moisture transfer characteristics. The first zone preferably contains a type 3 to type 5 desiccant, and the second zone contains a type 1 to type 3 desiccant.

In another aspect, the invention describes an energy exchange wheel which includes an energy exchange matrix which contains a combination of desiccant types over the entire matrix.

Figure 1:
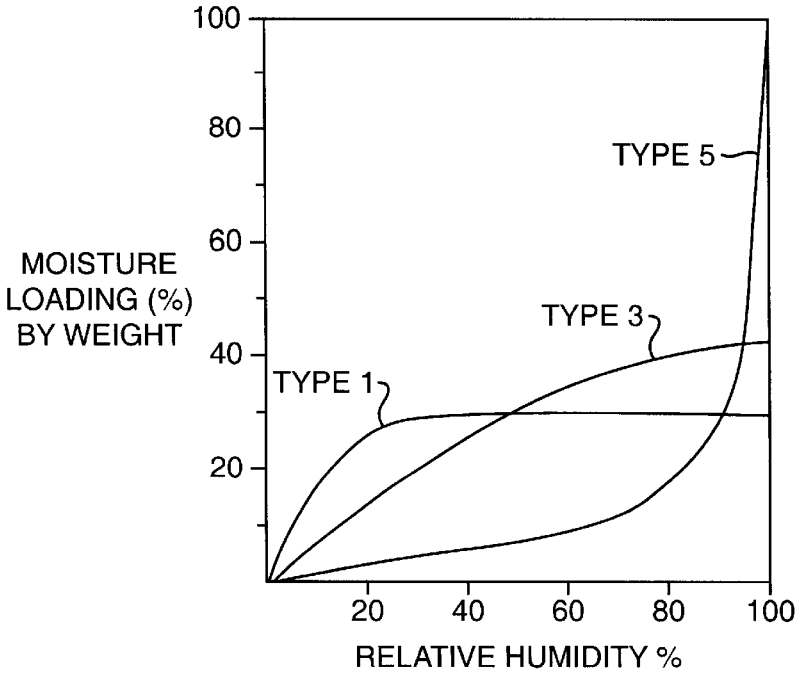
FIG. 1 is a graph illustrating the adsorption capacities of common desiccants.

As previously discussed, several types of desiccants are known, and each has a characteristic adsorption loading curve. The graph in FIG. 1 illustrates three common types of desiccants and suggests the suitability of a particular desiccant for a particular application. Molecular sieves, or zeolites, tend to adsorb principally at low relative humidities, and thus they are suitable for very low level drying applications, i.e., in airstreams which have less than 20 to 30% RH. Zeolites are classified under the Brunauer system of classification as Type 1 desiccants.

Normal silica gels tend to adsorb moisture over the entire range of relative humidities and are thus widely used. They will adsorb up to about 40% of their weight in moisture. Silica gels having this type of linear adsorption characteristic are classified under the Brunauer system as Type 3 desiccants.

Silica gels can be modified to provide low moisture adsorption at low relative humidities and high moisture adsorption at high relative humidities. Such modified silica gels are classified as Type 5 desiccants.

Figure 2A:
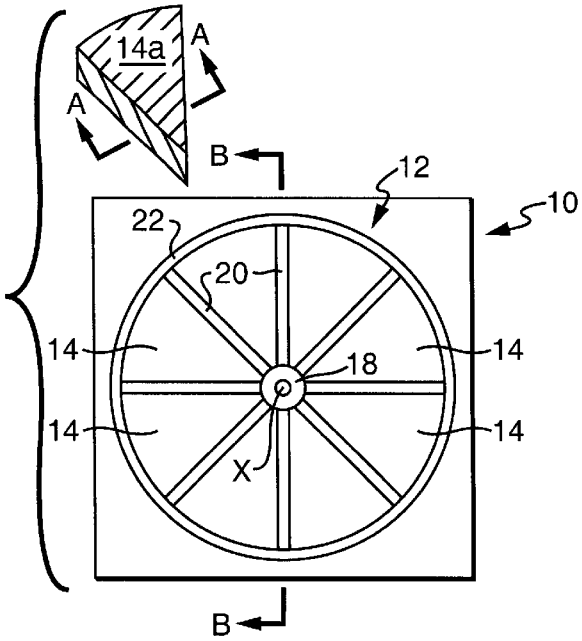
FIG. 2A is a front view of a regenerator energy exchange wheel according to one aspect of the invention, and a segment of the matrix of the wheel, removed to show that it can be interchanged with any of the segments of the wheel.
Figure 2B:
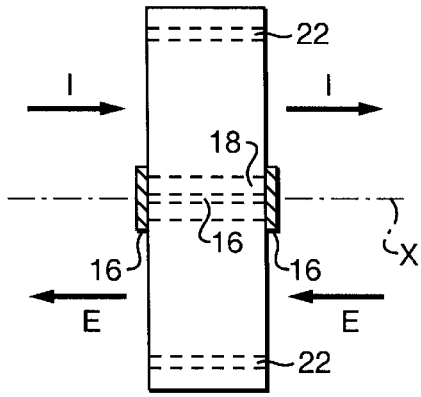
FIG. 2B is a section view of the wheel of FIG. 2A along section lines B—B, in which the airstreams through the wheel are shown.

FIGS. 2A and 2B show a regenerator energy exchange device 10 according to one aspect of the invention. The device includes a rotatable frame 12 which rotates about a rotation axis X. The frame supports an energy exchange matrix 14 which is made of a heat transfer material which facilitates the transfer of heat from air passing through the matrix. The frame supporting the matrix is disposed in an airflow path so that intake and exhaust airstreams I and E, respectively, can pass through the matrix 14 as they enter and leave the building. The frame cooperates with a seal 16 which bisects the energy exchange wheel, so that the intake airstream I and the exhaust airstream E do not mix as they pass through the matrix. The frame supporting the matrix is rotated slowly and continuously, and in this way the heat which has been transferred from intake air I passing through the top half of the matrix is captured in the heat transfer material of the matrix and is released to exhaust air E passing through the bottom half of the matrix.

The frame shown in the FIGURES includes a hub 18, a plurality of spokes 20 extending radially from the hub, and a rim 22 coupled to the spokes; however, other rotatable configurations may also be suitable in the present invention. The matrix shown in the FIGURES is separated into wedge-shaped segments 14*a*, 14*b*, etc. which, in one embodiment, are completely removable from the frame which supports the matrix. Because the segments can be removed from the frame, they can be interchanged at will. Interchangeability allows the segments, and thus the matrix and, by extension, the entire energy recovery device, to be customized for the application. This provides significant advantages in terms of versatility, reduced maintenance and labor costs, and increased comfort and effectiveness, especially in climates which experience a range of temperatures and relative humidities over the course of a season or year.

Typically, in summer conditions an intake airstream I from the outside of a building is both warmer and more humid than an exhaust airstream E which has been conditioned by the HVAC system within the building. Passage of an intake airstream I through the energy exchange matrix 14 allows heat to be transferred from this warmer outside air to cooler inside air being exhausted, thereby lowering the temperature of the intake airstream before it enters the building's air conditioning system.

Figure 3:
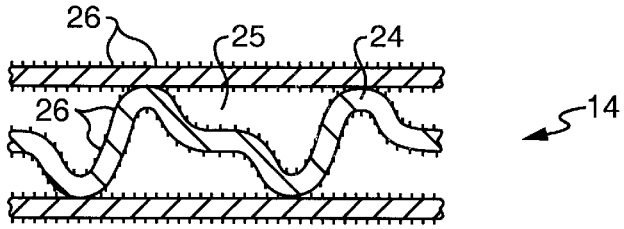
FIG. 3 is a section view of the matrix of the wheel of FIG. 2, taken along section lines A—A, in which a heat exchange material and a variety of desiccants are shown on the surfaces of the heat exchange material.

FIG. 3 shows a detail view of the composition of the matrix 14 along section lines A—A in FIG. 2A. The matrix is typically constructed of one or more layers or strips 15 of a heat exchange material, which can include both latent and sensible heat exchange materials, for transfer of both heat and moisture. The heat exchange material can be made of polystyrene or other suitable polymer having suitable heat transfer characteristics. The material may include indentations or protrusions 24 to provide means for spacing the layers or strips 15 apart from one another. Spaces 25 between the layers 15 allow air to flow through the matrix and contact more surfaces of the heat exchange material.

The heat exchange material further includes a desiccant 26 which is coated or deposited on the surfaces of the heat exchange material.

The matrix of the energy recovery device of the present invention includes interchangeable segments and therefore can vary in its moisture transfer capacity simply by changing one or more segments having a particular desiccant for one or more segments having a different desiccant. Alternatively, segments having a single desiccant coated thereon may be changed for segments having more than one desiccant coated thereon, to increase the moisture transfer capacity across a broader range of relative humidities and temperatures. The segments can have any combination of one or more desiccants on them, and they can be arranged in any order within the frame which supports the matrix. The speed of rotation of the frame can also be modified as needed with a particular matrix and desiccant combination to optimize heat and moisture transfer.

As mentioned, desiccants are classified according to the Brunauer classification system, which characterizes the capacity of the desiccant to adsorb moisture as a function of the relative humidity of the air contacting the desiccant. Type 1 desiccants, which include zeolites and molecular sieves, adsorb optimally at fairly low RH levels, up to about 30% RH only. Type 3 desiccants, which include most silica gels, adsorb optimally over the entire range of relative humidities and can adsorb up to about 40% of their weight in moisture. Some modified silica gels are classified as Type 5 desiccants, as they exhibit superior moisture adsorption capacities at relative humidities between about 50% and 100%.

The use of any combination of Types 1, 3 and 5 desiccants on a matrix of an energy exchange wheel allows one to customize the moisture transfer characteristics of the matrix to a high degree. Although Type 1 and 3 desiccants having higher moisture transfer capacities at low relative humidities have been favored for general use, Type 5 desiccants may become significant where the effectiveness of moisture transfer at high relative humidities is of critical importance. The combination of two or more different desiccants having different moisture adsorption characteristics on the same segments will result in a matrix having a composite or hybrid total moisture adsorption capacity which may be superior to that of the matrix if only one of the desiccants were applied to it.

Figure 4:
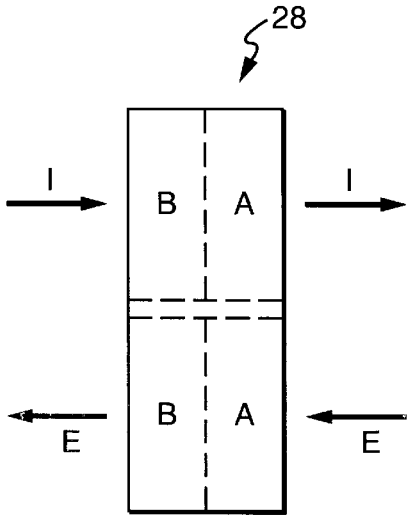
FIG. 4 is a side view of a multi-zoned wheel according to another aspect of the invention.
Figure 5:
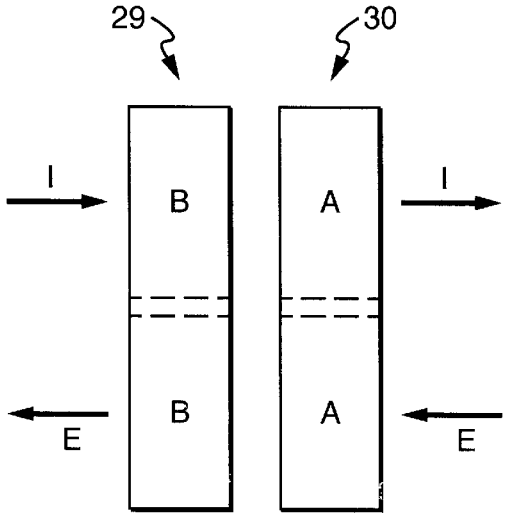
FIG. 5 is a side view of an alternative to the embodiment of FIG. 4, in which two wheels having a different matrix and desiccant composition are mounted in series to define a two-zoned system.

Another approach is illustrated in FIGS. 4 and 5. FIG. 4 is a side view of a multi-zoned energy exchange wheel 28. In this embodiment, the energy exchange device is zoned along the direction of the air flow path through it. In particular, the portion of the matrix which is first contacted by an intake airstream I having relatively high moisture content includes a desiccant, designated a Type 3 to 5 desiccant, which has good moisture adsorption at high relative humidities. The portion of the matrix which is first contacted by an exhaust airstream E having a lower moisture content includes a desiccant, designated a Type 1 to 3 desiccant, which has good moisture adsorption in the mid-range of relative humidities. Thus, a zoned energy recovery device according to the invention has a first zone of Type 3 to 5 desiccant for initial contact with humid outdoor air (I), and a second zone of Type 1 to 3 desiccant for initial contact with conditioned indoor air (E) being exhausted.

FIG. 5 illustrates a variation of this embodiment, in which multiple energy exchange wheels 29, 30 are mounted in series. Wheel 29 is on the leading edge of an intake airstream I and includes a Type 3 to 5 desiccant, as described above. Wheel 30 is on the leading edge of an exhaust airstream E and includes a Type 1 to 3 desiccant, as described above.

The embodiments of FIGS. 4 and 5 are shown as having two zones. However, they could have additional numbers of zones, each zone having a different desiccant or combination of desiccants which is/are selected according to the anticipated relative humidity range of the airstream which is contacting it.

Figure 6:
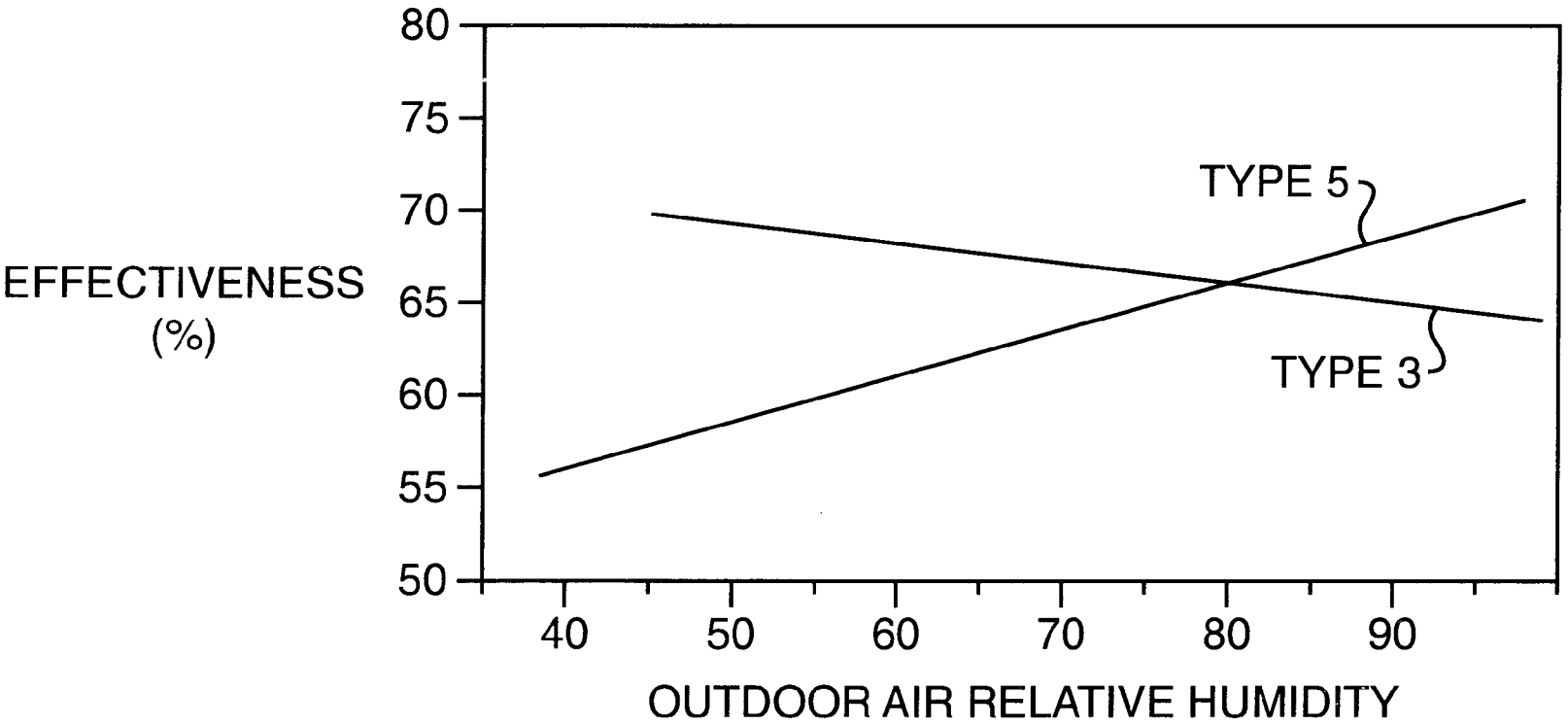
FIG. 6 is a graph illustrating the effectiveness functions of two different types of 20 micron silica gel as a function of relative humidity of the contacting airstream.

FIG. 6 is a graph showing the effectiveness, as a percentage, of Type 3 and Type desiccants as a function of outdoor relative humidity. The Type 3 desiccant has maximum effectiveness and moisture adsorption at low relative humidities and decreases in effectiveness as the relative humidity increases. In contrast, the Type 5 desiccant has a minimum effectiveness and moisture adsorption at low relative humidities and increases in effectiveness as the relative humidity increases. For equal amounts of Type 3 and Type 5 desiccants on a matrix, the Type 5 desiccant will adsorb more moisture than the Type 3 desiccant at high relative humidities, i.e., over about 80% relative humidity, such as would occur in summer conditions in many of the southern United States.

Because certain changes may be made in the above apparatus without departing from the scope of the invention herein disclosed, it is intended that all matter contained in the above description or shown in the accompanying drawings shall be interpreted in an illustrative and not a limiting sense.

What is claimed is:

1. A regenerator energy exchange device, comprising:

a frame which is rotatable about a rotation axis; and an energy exchange matrix supported by the frame and disposed to allow intake and exhaust air to pass therethrough, the matrix comprising a plurality of interchangeable segments, each of said segments containing at least one desiccant selected from the family of desiccants having Brunauer classification numbers between 1 and 5, wherein the matrix contains desiccants of at least two different Brunauer classifications.

2. A regenerator energy exchange device according to claim 1, wherein each segment contains a single class of desiccant thereon.

3. A regenerator energy exchange device according to claim 1, wherein at least one segment contains multiple different classes of desiccant thereon.

4. A regenerator energy exchange device according to claim 3, wherein all of the segments contain multiple different classes of desiccant thereon.

5. A regenerator energy exchange device according to claim 3, wherein each of the segments contains the same multiple classes of desiccants thereon.

6. A regenerator energy exchange device according to claim 1, wherein the matrix contains at least one Type 5 desiccant.

7. A regenerator energy exchange device according to claim 6, wherein the matrix additionally contains at least one desiccant selected from the group consisting of Type 1 and Type 3 desiccants.

8. A regenerator energy exchange device according to claim 1, wherein the frame includes a hub, a plurality of spokes extending from the hub, and a rim coupled to the plurality of spokes.

9. A regenerator energy exchange device, comprising:

a frame which is rotatable about a rotation axis; and an energy exchange matrix supported by the frame and disposed to allow intake and exhaust air to pass therethrough along a flow path, wherein the matrix contains at least one desiccant selected from the family of desiccants having Brunauer classification numbers between 1 and 5, wherein the matrix includes a plurality of zones disposed serially along the flow path, each zone containing a desiccant of a different class.

10. A regenerator energy exchange device according to claim 9, wherein the matrix includes a first zone closest to an intake airstream inlet and a second zone closest to an exhaust airstream inlet.

11. A regenerator energy exchange device according to claim 9, wherein the frame includes a hub, a plurality of spokes extending from the hub, and a rim coupled to the plurality of spokes.

12. A regenerator energy exchange device according to claim 9, wherein the matrix comprises a plurality of interchangeable segments, each segment containing at least one of the desiccants.

13. A regenerator energy exchange device, comprising:

a frame which is rotatable about a rotation axis; and an energy exchange matrix supported by the frame and disposed to allow intake and exhaust air to pass therethrough along a flow path, wherein the matrix contains at least two desiccants selected from the family of desiccants having Brunauer classification numbers between 1 and 5, wherein at least one of the desiccants has a Brunauer classification number between 1 to 3 inclusive, and wherein at least one of the desiccants has a Brunauer classification number between 3 and 5 inclusive, wherein each of the desiccants has a different Brunauer classification number.

* * * * *

UNITED STATES PATENT AND TRADEMARK OFFICE

CERTIFICATE OF CORRECTION

PATENT NO. : 6,408,932 B1 
DATED : June 25, 2002
INVENTOR(S) : Donald F. Steele et al.

It is certified that error appears in the above-identified patent and that said Letters Patent is hereby corrected as shown below:

Title page,
Item [57], ABSTRACT,
Line 13, delete "type 5" and insert therefor -- type III --
Line 15, delete "type 3" and insert therefor -- type II --

Drawings,
Sheet 1, Figure 1, delete the reference text "TYPE 1" and insert therefor the reference text -- TYPE I --
Sheet 1, Figure 1, delete the reference text "TYPE 3" and insert therefor the reference text -- TYPE II --
Sheet 1, Figure 1, delete the reference text "TYPE 5" and insert therefor the reference text -- TYPE III --
Sheet 3, Figure 6, delete the reference text "TYPE 3" and insert therefor the reference text -- TYPE II --
Sheet 3, Figure 6, delete the reference text "TYPE 5" and insert therefor the reference text -- TYPE III --

Column 2,
Line 31, delete "Type 1" and insert therefor -- Type I --
Line 39, delete "Type 3" and insert therefor -- Type II --
Line 53, delete "Type 5" and insert therefor -- Type III --

Column 3,
Line 1, delete "Type 3" and insert therefor -- Type II --
Line 1, delete "Type 5" and insert therefor -- Type III --
Line 19, delete "Type 1 and 5" and insert therefor -- I and III --
Line 29, delete "Type 5" and insert therefor -- Type III --
Line 31, delete "Type 1 and Type 3" and insert therefor -- Type I and Type II --
Lines 46 and 64, delete "1 and 5" and insert therefor -- I and III --
Line 62, delete "3 and 5" and insert therefor -- II and III --
Line 66, delete "1 and 3" and insert therefor -- I and II --
Line 67, delete "3 and 5" and insert therefor -- II and III --

Column 4,
Line 12, delete "1 and 5" and insert therefor -- I and III --
Lines 15-16, delete "type 3 to type 5" and insert therefor -- type II to type III --
Line 17, delete "type 1 to type 3" and insert therefor -- type I to type II --

UNITED STATES PATENT AND TRADEMARK OFFICE

CERTIFICATE OF CORRECTION

PATENT NO. : 6,408,932 B1
DATED : June 25, 2002
INVENTOR(S) : Donald F. Steele et al.

It is certified that error appears in the above-identified patent and that said Letters Patent is hereby corrected as shown below:

Column 5,
Line 17, delete "type 3 to type 5" and insert therefor -- type II to type III --
Line 18, delete "type 1 to type 3" and insert therefor -- type I to type II --
Line 32, delete "Type 1" and insert therefor -- Type I --
Line 37, delete "Type 3" and insert therefor -- Type II --
Line 42, delete "Type 5" and insert therefor -- Type III --

Column 6,
Line 54, delete "Type 1" and insert therefor -- Type I --
Line 56, delete "Type 3" and insert therefor -- Type II --
Lines 59-60, delete "Type 5" and insert therefor -- Type III --
Line 63, delete "Types 1, 3 and 5" and insert therefor -- Type I, II and III --
Line 66, delete "Type 1 and 3" and insert therefor -- Type I and Type II --

Column 7,
Line 2, delete "Type 5" and insert therefor -- Type III --
Lines 17 and 31, delete "Type 3 and 5" and insert therefor -- Type II and III --
Lines 21 and 26, delete "Type 1 and 3" and insert therefor -- Type I and II --
Lines 24-25, delete "Type 3 and 5" and insert therefor -- Type II and III --
Line 33, delete "Type 1 to 3" and insert therefor -- Type I and II --
Line 41, delete "Type 1" and insert therefor -- Type I --
Lines 42, 48 and 50, delete "Type 3" and insert therefor -- Type II --
Line 45, delete "Type 5" and insert therefor -- Type III --
Line 49, delete "and Type 5" and insert therefor -- the Type III --
Line 49, delete "the Type 5" and insert therefor -- the Type III --

UNITED STATES PATENT AND TRADEMARK OFFICE

CERTIFICATE OF CORRECTION

PATENT NO. : 6,408,932 B1 
DATED : June 25, 2002
INVENTOR(S) : Donald F. Steele et al.

It is certified that error appears in the above-identified patent and that said Letters Patent is hereby corrected as shown below:

Column 8,
Lines 4, 36 and 59, delete "1 and 5" and insert therefor -- I and III --
Line 19, delete "Type 5" and insert therefor -- Type III --
Lines 23 and 24, delete "Type 1 and Type 3" and insert therefor -- Type I and Type II --
Line 60, delete "1 to 3" and insert therefor -- I to II --

Signed and Sealed this

Fifteenth Day of July, 2003

JAMES E. ROGAN
*Director of the United States Patent and Trademark Office*